US011815834B2

(12) United States Patent
Chikugo et al.

(10) Patent No.: US 11,815,834 B2
(45) **Date of Patent: *Nov. 14, 2023**

(54) IMAGE FORMING APPARATUS

(71) Applicant: CANON KABUSHIKI KAISHA, Tokyo (JP)

(72) Inventors: Youichi Chikugo, Chiba (JP); Hidekazu Tatezawa, Saitama (JP); Yutaro Tsuno, Tokyo (JP); Kenichi Tanaka, Ibaraki (JP); Rikiya Takemasa, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/700,673

(22) Filed: Mar. 22, 2022

(65) Prior Publication Data

US 2022/0214635 A1 Jul. 7, 2022

Related U.S. Application Data

(62) Division of application No. 17/146,612, filed on Jan. 12, 2021, now Pat. No. 11,307,520.

(30) Foreign Application Priority Data

Jan. 17, 2020 (JP) ..... 2020-005982

(51) Int. Cl.
*G03G 15/20* (2006.01)
*G03G 21/00* (2006.01)

(52) U.S. Cl.
CPC ..... *G03G 15/2025* (2013.01); *G03G 21/0041* (2013.01)

(58) Field of Classification Search
CPC ..... G03G 15/2025
See application file for complete search history.

(56) References Cited

U.S. PATENT DOCUMENTS

| | | | | |
|---|---|---|---|---|
| 9,091,975 | B2 | 7/2015 | Hara | |
| 9,152,099 | B2 * | 10/2015 | Ueno | G03G 15/2025 |
| 9,207,592 | B2 * | 12/2015 | Nakamura | G03G 15/2025 |
| 9,454,111 | B2 | 9/2016 | Hatazaki | |
| 9,696,672 | B2 * | 7/2017 | Ono | F16H 37/12 |

(Continued)

FOREIGN PATENT DOCUMENTS

| | | | |
|---|---|---|---|
| JP | 2004-212409 A | | 7/2004 |
| JP | 2011221438 A | * | 11/2011 |
| JP | 2019-101335 A | | 6/2019 |

*Primary Examiner* — Leon W Rhodes, Jr.
(74) *Attorney, Agent, or Firm* — Venable LLP

(57) ABSTRACT

An image forming apparatus includes an image forming unit, first and second rotary members, a cleaning mechanism, and a separating mechanism. The first and second rotary members cooperatively form a nip portion configured to nip and convey the recording material while heating and fixing the tonner image onto the recording material. The cleaning mechanism includes a collecting roller. The cleaning mechanism is configured to clean the first rotary member by bringing the cleaning web into contact with the collecting roller that is in contact with the first rotary member and rotates together with the first rotary member. The separating mechanism is configured to separate the cleaning web from the collecting roller when the collecting roller is separated from the first rotary member.

7 Claims, 7 Drawing Sheets

(56) References Cited

U.S. PATENT DOCUMENTS

| | | | | |
|---|---|---|---|---|
| 10,162,292 | B2 | 12/2018 | Mogi | |
| 10,459,376 | B2 | 10/2019 | Saito et al. | |
| 11,307,520 | B2 * | 4/2022 | Chikugo | G03G 21/0041 |
| 2018/0284660 | A1 * | 10/2018 | Takematsu | G03G 15/2025 |

* cited by examiner

FIG.6

| CONDITIONS | | | | | | DETERMINATION |
|---|---|---|---|---|---|---|
| USE CONDITION | SHEET PASSING CONDITION | | | | | WHETHER CLEANING OPERATION IS EXECUTED |
| | NORMAL SHEET PASSING CONDITION | HIGH PRODUCTION MODE | | HIGH GLOSS MODE | | |
| | | FIRST GRAMMAGE CONDITION | SECOND GRAMMAGE CONDITION | FIRST TEMPERATURE CONDITION | SECOND TEMPERATURE CONDITION | |
| IN PASSING PLAIN SHEET | | ● | | ● | ● | EXECUTE |
| | ● | | ● | | | NOT EXECUTE |
| IN PASSING GLOSS SHEET | | ● | | | ● | EXECUTE |
| | ● | | ● | ● | | NOT EXECUTE |
| IN PASSING FILM AND RESIN SHEET | | ● | | | ● | EXECUTE |
| | ● | | ● | ● | | NOT EXECUTE |
| IN PASSING RECYCLED SHEET | ● | ● | ● | ● | ● | EXECUTE |
| IN PASSING EMBOSSED SHEET | ● | ● | ● | ● | ● | EXECUTE |
| IN RETURNING FROM ABNORMALITY | ● | ● | ● | ● | ● | EXECUTE |

IMAGE FORMING APPARATUS

This is a divisional of U.S. patent application Ser. No. 17/146,612, filed Jan. 12, 2021.

BACKGROUND OF THE INVENTION

Field of the Invention

The present invention relates to an image forming apparatus such as a copier, a printer, a facsimile machine and a multi-function printer including the plurality of those functions.

Description of the Related Art

Hitherto, there has been known an image forming apparatus including a fixing unit configured to fix a toner image which has been formed on a recording material by utilizing an electro-photographic system or the like on the recording material by heating the recording material on which the toner image has been formed. As the fixing unit, there has been known one including a fixing roller having a heat source therein and a pressure roller configured to nip a recording material by being in pressure contact with the fixing roller for example (see Japanese Patent Application Laid-Open No. 2004-212409).

Here, there is a possibility that foreign substances such as toner adhere on the fixing roller. Due to that, Japanese Patent Application Laid-Open No. 2004-212409 is arranged such that a metallic cleaning roller is brought into contact with the fixing roller to clean a surface of the fixing roller and a web is brought into contact with the cleaning roller to clean the cleaning roller.

Here, there is also a demand of suppressing a consumption amount of the web in the arrangement of cleaning the cleaning roller by the web. However, in a case of the arrangement of Japanese Patent Application Laid-Open No. 2004-212409, it is difficult to suppress the consumption amount of the web because the fixing roller, the cleaning roller and the web are kept in contact with each other.

Although it is conceivable to separate the cleaning roller, i.e., a collecting roller, from a rotary member such as the fixing roller to that end, there is also a possibility that if the cleaning roller is kept in contact with the web, the cleaning roller adheres with the web by toner left on the cleaning roller. If the cleaning roller adheres with the web, there is a possibility that the web is drawn out so as to be wound up by the cleaning roller in driving the web next.

SUMMARY OF THE INVENTION

The present disclosure aims at providing an image forming apparatus configured to be able to suppress the cleaning roller from adhering with the cleaning web while separating the cleaning roller from the rotary member in the arrangement in which the cleaning web for cleaning the cleaning roller is provided.

According to one aspect of the present invention, an image forming apparatus includes an image forming unit configured to form a toner image on a recording material, first and second rotary members cooperatively forming a nip portion configured to nip and convey the recording material while heating and fixing the toner image onto the recording material, a cleaning mechanism including a collecting roller coming into contact with the first rotary member to collect toner on the first rotary member and a cleaning web coming into contact with the collecting roller to clean the collecting roller, the cleaning mechanism being configured to clean the first rotary member by bringing the cleaning web into contact with the collecting roller that is in contact with the first rotary member and rotates together with the first rotary member, and, a separating mechanism configured to separate the cleaning web from the collecting roller when the collecting roller is separated from the first rotary member.

Further features of the present invention will become apparent from the following description of exemplary embodiments with reference to the attached drawings.

BRIEF DESCRIPTION OF THE DRAWINGS

FIG. 6 is a table indicative of a cleaning operation mode of the present exemplary embodiment.

DESCRIPTION OF THE EMBODIMENTS

Figure 1:
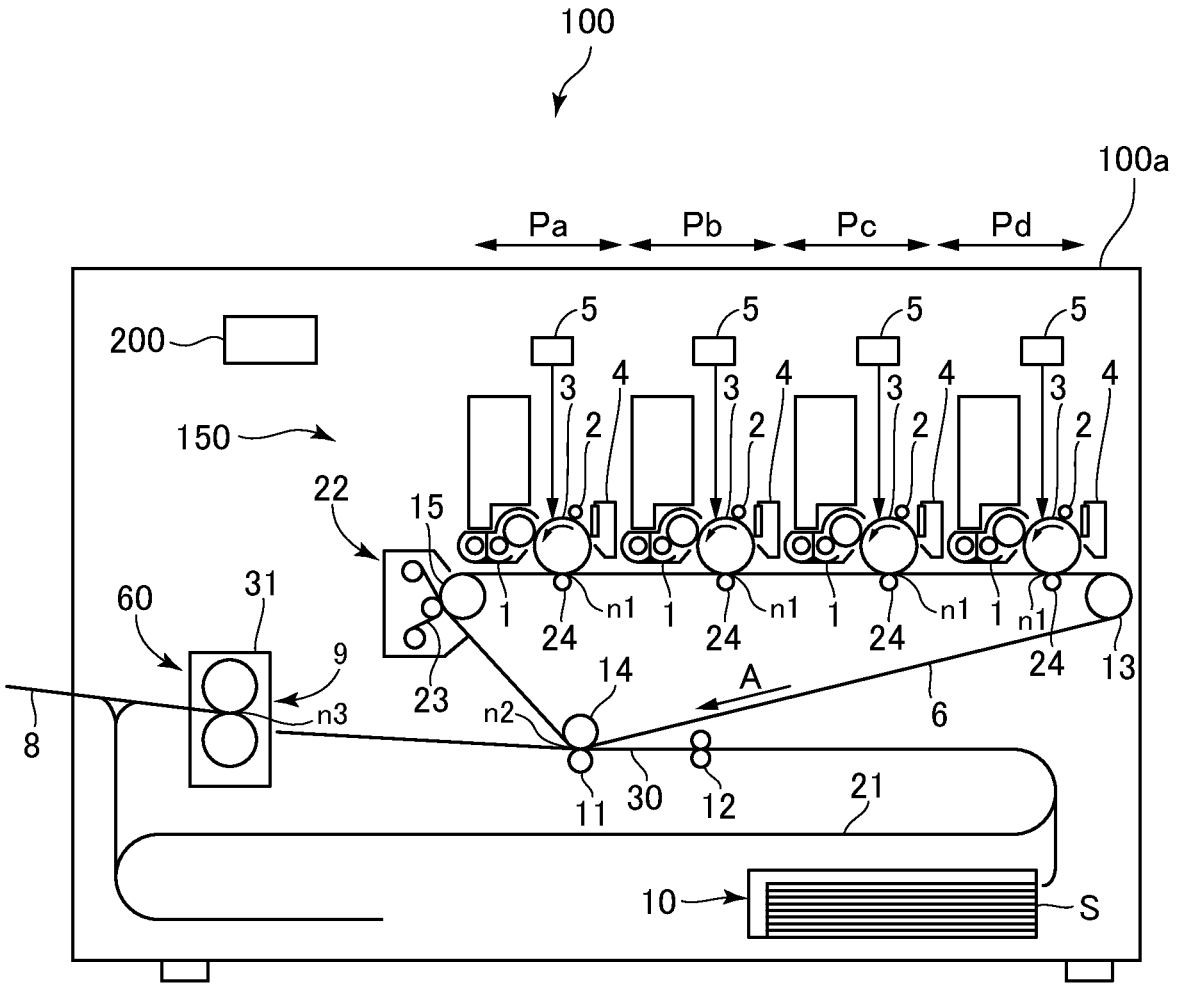
FIG. 1 is a section view illustrating a schematic configuration of an image forming apparatus of a present exemplary embodiment.

An exemplary embodiment will be described with reference to FIGS. 1 through 7. At first, a schematic configuration of an image forming apparatus 100 of the present exemplary embodiment will be described with reference to FIG. 1.

Image Forming Apparatus

The image forming apparatus 100 is an electro-photographic type full-color printer including four image forming portions Pa, Pb, Pc and Pd provided corresponding to four colors of yellow, magenta, cyan and black. In the exemplary embodiment, the image forming apparatus 100 is configured to be a tandem type printer in which the image forming portions Pa, Pb, Pc and Pd arrayed along a rotation direction of an intermediate transfer belt 6 described later. The image forming apparatus 100 forms a toner image, i.e., an image, on a recording material in accordance to an image signal received from a document reading apparatus connected with an apparatus body 100*a* of the image forming apparatus 100 or a host device such as a personal computer communicably connected with the apparatus body 100*a*. The recording material may be a sheet of paper, a plastic film and a sheet member such as a cloth.

While the apparatus body 100*a* includes the image forming portions Pa, Pb, Pc and Pd, each of the image forming portions forms an image based on the image signal described above. That is, the image signal is converted into a laser beam to which PWM (pulse-width modulation control) has been executed by a control portion 200. A laser scanner 5 serving as an exposing unit scans the laser beam corresponding to the image signal. Then, a photosensitive drum 3 serving as an image bearing member of the respective image forming portions Pa through Pd is irradiated with the laser beam.

Note that Pa denotes the image forming portion of yellow (Y), Pb denotes that of magenta (M), Pc denotes that of cyan (C) and Pd denotes that of black (Bk). The respective image forming portions form images of the corresponding colors. Because the configurations of the image forming portions Pa through Pd are approximately the same, so that the image forming portion Pa of yellow will be described in detail below and descriptions of the other image forming portions Pb, Pc, and Pd will be omitted here. In the image forming portion Pa, a toner image is formed on a surface of the photosensitive drum 3 based on the image signal, as follows.

A charging roller 2 serving as a primary charger charges the surface of the photosensitive drum 3 to a predetermined potential to be ready to form an electrostatic latent image. The electrostatic latent image is formed on the surface of the photosensitive drum 3 charged at the predetermined potential by the laser beam from the laser scanner 5. A developer 1 forms the toner image by developing the electrostatic latent image on the photosensitive drum 3 by toner.

Here, the toner used in the present exemplary embodiment contains paraffin or wax composed of polyolefin and silicon oil serving as a releasing agent. Specifically, the toner in which such wax component and pigment are finely dispersed within grinded toner is used. Note that the toner may be arranged so as to use polymerized toner containing such wax component. While the toner containing wax as a releasing agent will be illustrated in the following description, the same applies to a case where silicon oil is used as the releasing agent as described above.

A primary transfer roller 24 discharges electricity from a back of the intermediate transfer belt 6 to apply a primary transfer bias with a polarity reverse to that of the toner to transfer the toner image on the photosensitive drum 3 onto the intermediate transfer belt 6 at a primary transfer portion n1. The intermediate transfer belt 6 is configured to rotate with an equal peripheral speed with the photosensitive drum 3 in a direction of an arrow A by being stretched by tension rollers 13, 14 and 15. The surface of the photosensitive drum 3 is cleaned by a cleaner 4 after transferring the toner image onto the intermediate transfer belt 6.

The toner image on the intermediate transfer belt 6 is conveyed to the next image forming portion and the toner images of the respective colors formed by the respective image forming portions are transferred onto the surface of the intermediate transfer belt 6 sequentially in order of Y, M, C and Bk to form four color images. Then, the toner image which has passed through the image forming portion Pd of Bk located at a most downstream in the rotation direction of the intermediate transfer belt 6 is conveyed to a secondary transfer portion n2 composed of a secondary transfer roller 11 and the tension roller 14. Then, a secondary transfer electric field having a polarity reverse to that of the toner image on the intermediate transfer belt 6 is applied to the secondary transfer portion n2 to secondarily transfer the toner image onto a recording material S.

The toner image secondarily transferred is formed onto the recording material S while leaving certain margins from edges of four sides. A margin at a leading edge is around 2 to 3 mm in the present exemplary embodiment. Note that transfer residual toner and other foreign substances left on the intermediate transfer belt 6 are removed by a cleaning web 23 which is formed of a nonwoven fabric in a belt cleaner 22 and which is rubbed against the surface of the intermediate transfer belt 6.

The recording material S stored in and fed from a cassette 10 is conveyed to a registration portion 12 composed of a pair of registration rollers for example and stands by at the registration portion 12. Then, the registration portion 12 conveys the recording material S to the secondary transfer portion n2 while controlling conveyance timing to adjust the toner image on the intermediate transfer belt 6 with the recording material S. A configuration including the respective image forming portions Pa through Pd, the intermediate transfer belt 6 and others and until when the toner image is secondarily transferred onto the recording material as described above will be referred to as an image forming unit 150 for forming the toner image on the recording material S.

The recording material S onto which the toner image has been transferred at the secondary transfer portion n2 is conveyed to a fixing unit 9 and is heated and pressed there to fix the toner image borne on the recording material S to the recording material S. The recording material S that has passed through the fixing unit 9 is discharged onto a discharge tray 8. Note that in a case where images are to be formed on both surface of the recording material S, front and back surfaces of the recording material S are reversed at a reverse conveyance portion 21 after finishing transferring and fixing the toner image onto a first face, i.e., the front surface, of the recording material S. Then, a toner image is transferred and fixed onto a second face, i.e., the back surface, of the recording material S. After that, the recording material S is stacked on the discharge tray 8.

Fixing Unit

Next, a schematic configuration of the fixing unit 9 of the present exemplary embodiment will be described with reference to FIG. 2. As described later, the fixing unit 9 of the present exemplary embodiment includes a configuration of fixing the toner image formed on the recording material by using toner containing releasing agent by applying heat and pressure to the toner image.

The fixing unit 9 including a cleaning unit 60 is disposed within a casing 31 (see FIG. 1) supported within the apparatus body 100*a*. The fixing unit 9 includes a fixing roller 40 serving as a first rotary member or as a fixing rotary member, a counter roller 41 serving as a second rotary member or as a pressing rotary member and the cleaning unit 60 serving as a cleaning mechanism for cleaning a surface of the fixing roller 40. The cleaning unit 60 is disposed above the fixing roller 40. In the fixing unit 9 constructed as described above, the counter roller 41 is in pressure contact with the fixing roller 40 with a total pressure of about 784 [N], i.e., about 80 [kg] and forms a heating nip portion n3 for heating while nipping and conveying the recording material S.

That is, the counter roller 41 that is in contact with the fixing roller 40 forms the heating nip portion n3 to heat the image, i.e., the toner image, on the recording material. Thus, the fixing roller 40 and the counter roller 41 cooperatively form the heating nip portion n3 for nipping the recording material S and for heating and fixing the toner image onto the recording material S. That is, the fixing unit 9 fixes the non-fixed toner image secondarily transferred onto the recording material S in the image forming unit 150 to the recording material S while nipping and conveying the recording material S by the heating nip portion n3 between the fixing roller 40, that comes into contact with an image surface, and the counter roller 41.

The fixing roller 40 is the fixing rotary member that comes into contact with the toner image to fix the toner image onto the recording material S. According to the present exemplary embodiment, the fixing roller 40 includes a cylindrical core metal 40*b* made of aluminum and an elastic layer 40*c* of 3 mm thick for example which is disposed around an outer circumferential face of the core metal 40*b*. The fixing roller 40 is formed into a cylindrical roller having 60 mm in diameter for example. An under layer of the elastic layer 40*c* is a HTV (high-temperature vulcanized) silicon rubber layer, and a RTV (room-temperature vulcanized) or an LTV (low-temperature vulcanized) silicon rubber layer serving as a heat resistant elastic layer that comes into contact with the image surface is disposed around an outer circumferential face of the HTV silicon rubber layer. A fluorine-based resin, e.g., a PFA tube in the present exemplary embodiment, serving as a heat resistant releasing layer 40*d* is coated on the elastic layer 40*c* to improve releasability from toner.

The fixing roller 40 also includes a fixing roller heater 40*a* serving as a heating portion for heating the fixing roller 40. The fixing roller heater 40*a* is disposed unrotatably at a center part of the core metal 40*b* of the fixing roller 40 and is a halogen heater of a predetermined rated power that heats the fixing roller 40 such that a surface temperature of the fixing roller 40 converges to a predetermined temperature. A set temperature of the fixing roller heater 40*a* may be changed under control of a fixing unit control portion 202 (see FIG. 5) described later. According to the present exemplary embodiment, the fixing unit 9 includes a temperature detection sensor 42*a* serving as a temperature detection member for detecting the surface temperature of the fixing roller 40. The fixing unit control portion 202 controls the fixing roller heater 40*a* such that the surface temperature of the fixing roller 40 converges to the predetermined temperature based on an output of the temperature detection sensor 42*a*.

Note that it is possible to arrange so as to heat the fixing roller 40 by including a heater in an intermediate cleaning roller 62 described later and by heating the intermediate cleaning roller 62 itself. In this case, the fixing unit control portion 202 may control the heater of the intermediate cleaning roller 62 based on the output of the temperature detection sensor 42*a*.

The counter roller 41 is disposed so as to face the fixing roller 40 and forms the heating nip portion n3 together with the fixing roller 40 as described above. According to the present exemplary embodiment, the counter roller 41 includes a cylindrical core metal 41*b* made of aluminum and an elastic layer 41*c* of 1 mm thick for example disposed around an outer circumferential face of the core metal 41*b*. The counter roller 41 is formed into a cylindrical roller having 60 mm in diameter for example. An under layer of the elastic layer 41*c* is a HTV silicon rubber layer, and a RTV (room-temperature vulcanized) or an LTV (low-temperature vulcanized) silicon rubber layer serving as a heat resistant elastic layer that comes into contact with the image surface is disposed around an outer circumferential face of the HTV silicon rubber layer. A fluorine-based resin, e.g., a PFA tube in the present exemplary embodiment, for example serving as a heat resistant releasing layer 41*d* is coated on the elastic layer 41*c* to improve releasability from toner.

The counter roller 41 also includes a counter roller heater 41*a* serving as a heating portion for heating the counter roller 41. The counter roller heater 41*a* is disposed unrotatably at a center part of the core metal 41*b*. The counter roller heater 41*a* is a halogen heater of a predetermined rated power that heats the counter roller 41 such that a surface temperature of the counter roller 41 converges to a predetermined temperature. According to the present exemplary embodiment, the fixing unit 9 includes a temperature detection sensor 42*b* for detecting the surface temperature of the counter roller 41. The fixing unit control portion 202 controls the counter roller heater 41*a* such that the surface temperature of the counter roller 41 converges to the predetermined temperature based on an output of the temperature detection sensor 42*b*.

According to the present exemplary embodiment, releasability against sharp melt toner is improved further by combining the fixing roller 40 and the counter roller 41 having the layer structure as described above. Still further, in order to fix images on both surfaces, the heat resistant releasing layers 40*d* and 41*d* having a high toner releasing effect is provided not only on the surface of the fixing roller 40 but also on the surface of the counter roller 41.

Both ends of the fixing roller 40 and the counter roller 41 are rotatably supported by ball bearings not illustrated. The fixing roller 40 and the counter roller 41 rotate in directions of arrows K and L, respectively, as gears not illustrated fixed to one axial end portion of the respective rollers are linked with each other by a gear mechanism not illustrated and are integrally and rotationally driven by a fixing roller motor 211 (see FIG. 5). Note that a motor for driving the counter roller 41 may be separately provided so as to drive the fixing roller 40 and the counter roller 41 with different motors.

As described above, the temperature detection sensor 42*a* composed of a thermistor and others is disposed within the casing 31 so as to detect the surface temperature of the fixing roller 40 by being in contact with the surface of the fixing roller 40. The temperature detection sensor 42*a* is disposed upstream of the heating nip portion n3 in the rotation direction of the fixing roller 40. The temperature detection sensor 42*a* is connected with the fixing unit control portion 202 (see FIG. 5). The fixing unit control portion 202 adjusts a power supplied to the fixing roller heater 40*a* such that the surface temperature of the fixing roller 40 detected by the temperature detection sensor 42*a* converges to the predetermined temperature, e.g., about 165° C.

Cleaning Unit

Figure 3:
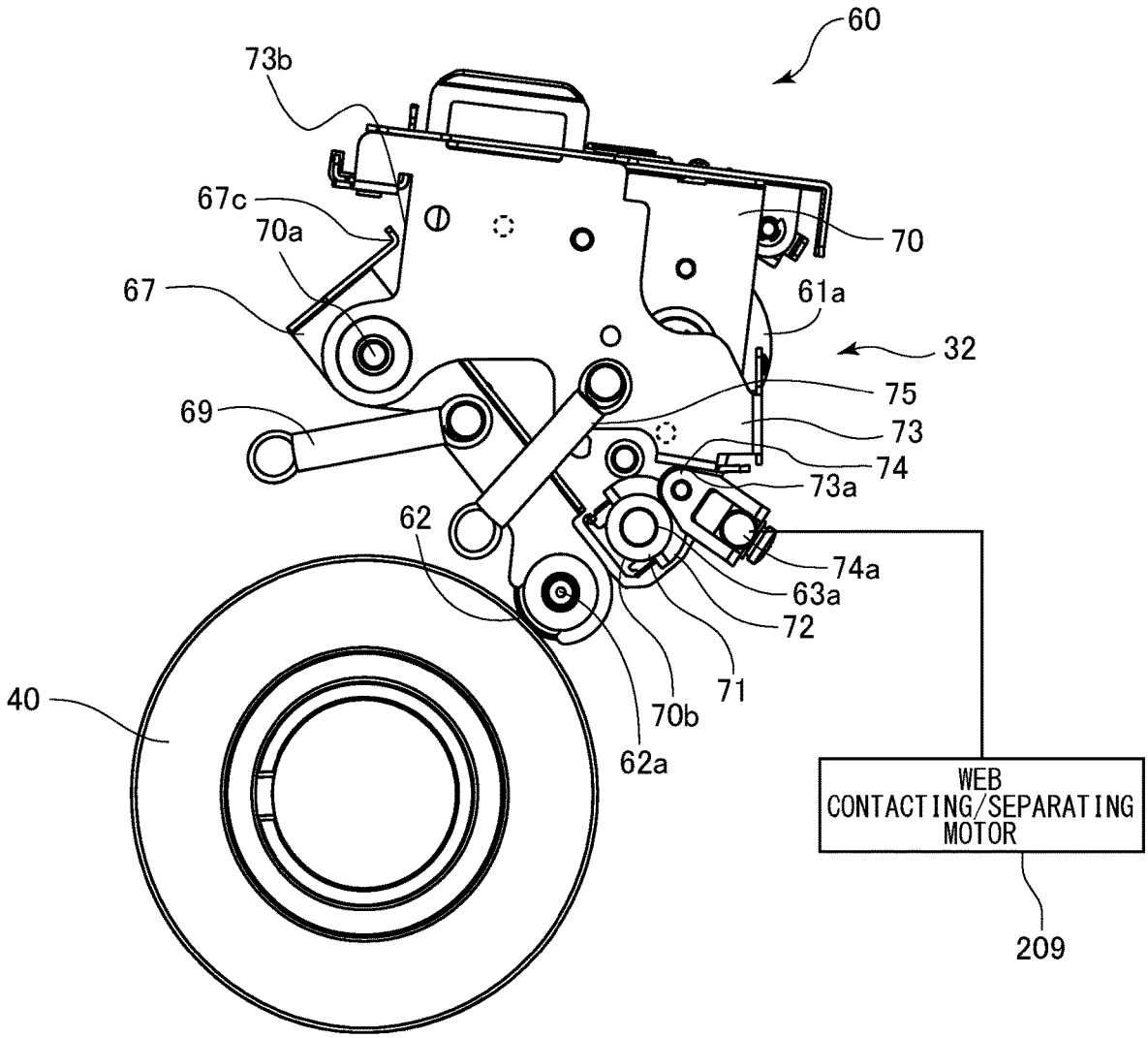
FIG. 3 illustrates a mechanism for contacting/separating a web and an intermediate cleaning roller of the present exemplary embodiment.
Figure 4A:
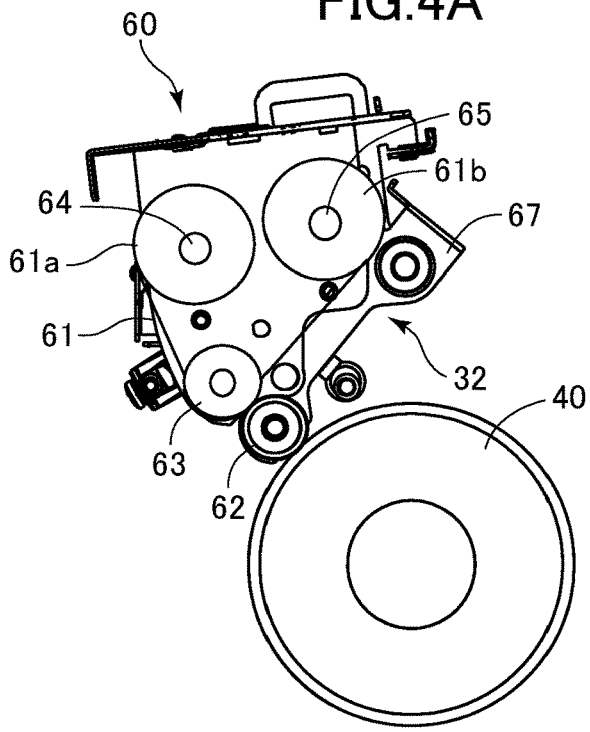
FIG. 4A illustrates a total contact state in which a fixing roller, the intermediate cleaning roller and the web of the present exemplary embodiment are in contact with each other.
Figure 4B:
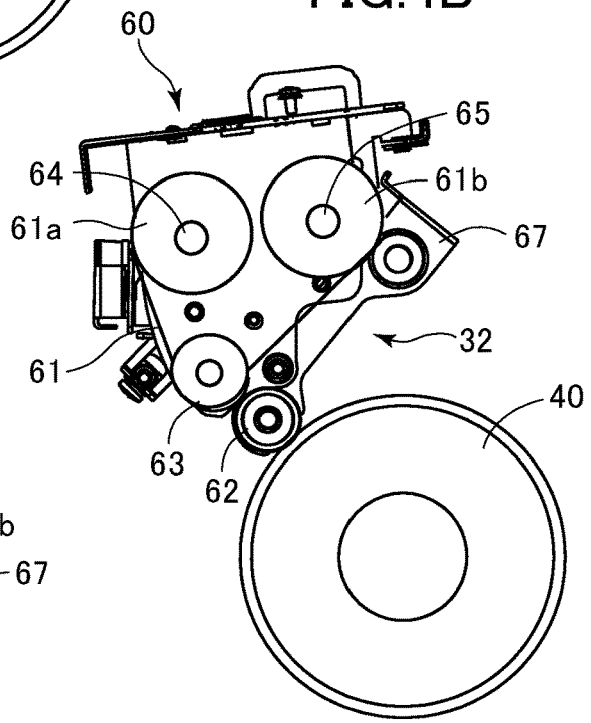
FIG. 4B illustrates an intermediate contact state in which the fixing roller is in contact with the intermediate cleaning roller and the intermediate cleaning roller is separated from the web of the present exemplary embodiment.
Figure 4C:
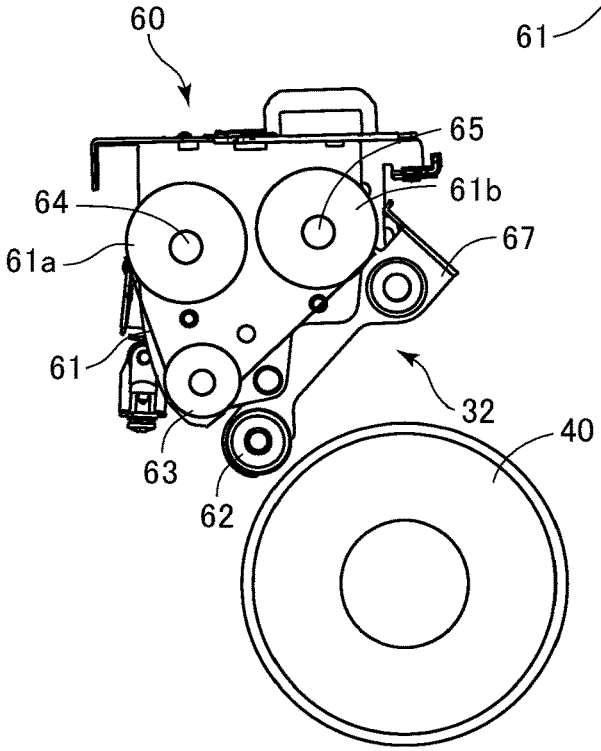
FIG. 4C illustrates a total separation state in which the fixing roller, the intermediate cleaning roller and the web of the present exemplary embodiment are totally separated.

Next, the cleaning unit 60 will be described with reference to FIGS. 2 through 4C. Note that FIG. 3 is a schematic diagram illustrating a contacting/separating mechanism 32 that brings the intermediate cleaning roller 62 into contact with or in separation from a web roller 63 and is a view when the contacting/separating mechanism 32 in FIGS. 2 and 4A through 4C is seen from a back side of the drawings. FIGS. 4A through 4C are schematic diagrams illustrating contact and separation states of the intermediate cleaning roller 62 and the web roller 63.

The cleaning unit 60 is what cleans the surface of the fixing roller 40 and includes a metallic intermediate cleaning roller 62 serving as a collecting roller, a web, i.e., a cleaning web, 61 serving as a cleaning member, the contacting/separating mechanism 32 and others. The intermediate cleaning roller 62 cleans the fixing roller 40 by coming into contact with the fixing roller 40. Specifically, the intermediate cleaning roller 62 collects toner on the fixing roller 40 by coming into contact with the fixing roller 40. The web 61 cleans the intermediate cleaning roller 62 by coming into contact with the intermediate cleaning roller 62. The contacting/separating mechanism 32 is configured to move the intermediate cleaning roller 62 and the web 61.

In a case of the present exemplary embodiment as described above, it is possible to put the intermediate cleaning roller 62 and the web 61 into three states as illustrated in FIGS. 4A through 4C by operating the contacting/separating mechanism 32. Firstly, FIG. 4A illustrates a total contact state, i.e., a first contact state, in which the fixing roller 40 is brought into contact with the intermediate cleaning roller 62 and the intermediate cleaning roller 62 is brought into contact with the web 61. FIG. 4B illustrates an intermediate contact state, i.e., a second contact state, in which the fixing roller 40 is brought into contact with the intermediate cleaning roller 62 and the intermediate cleaning roller 62 is separated from the web 61. FIG. 4C illustrates a total separation state, a third contact state, in which the fixing roller 40, the intermediate cleaning roller 62 and the web 61 are separated, respectively. These states will be described in detail below.

Figure 2:
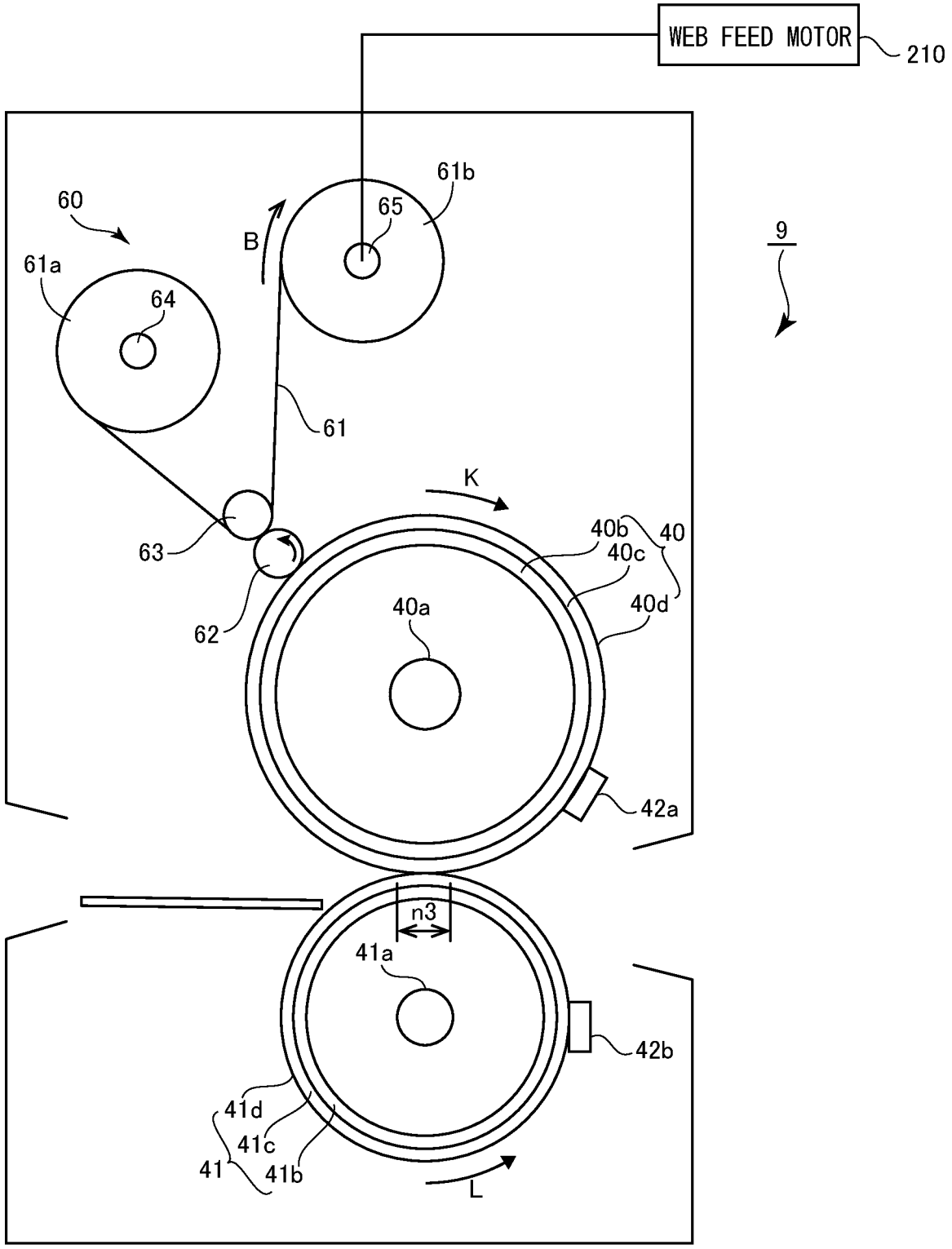
FIG. 2 is a section view illustrating a schematic configuration of a fixing unit of the present exemplary embodiment.

As illustrated in FIGS. 2 and 4A, the intermediate cleaning roller 62 is disposed between the fixing roller 40 and the web 61 during the cleaning operation of the cleaning unit 60. The intermediate cleaning roller 62 is rotationally driven by the fixing roller 40 and collects toner and foreign substances on the fixing roller 40. The web 61 is rubbed against the intermediate cleaning roller 62 to clean the toner and foreign substances collected by the intermediate cleaning roller 62. That is, the cleaning unit 60 cleans the fixing roller 40 by bringing the intermediate cleaning roller 62 into contact with the fixing roller 40 and by bringing the web 61 into contact with the intermediate cleaning roller 62 that rotates together with the fixing roller 40. Because the intermediate cleaning roller 62 executes the indirect contact of the web 61 with the fixing roller 40, the intermediate cleaning roller 62 suppresses a phenomenon of stripes otherwise caused on an output image as the fixing roller 40 is scratched by being rubbed by the foreign substances restrained by the web 61.

As illustrated in FIG. 2, the web 61 serving as a cleaning member is a nonwoven sheet of about 5 meters long in total wound into a roll. A feed end portion 61*a* of the web 61 is fixed to a roll core and is removably supported by a support shaft 64 supported to a web frame 70 (see FIG. 3). The support shaft 64, i.e., the feed roller, which is one example of a mount portion is mounted rotatably in a rewind direction in a state in which an unused part of the web 61 is wound up.

A winding end portion 61*b* of the web 61 is removably held around a driving shaft 65 supported by the web frame 70. A web feed motor 210 is connected at one end of the driving shaft 65 to wind up the web 61. The web 61 is bridged over the web roller 63 serving as a pressing member, and a part bridged over the web roller 63 is rubbed against the intermediate cleaning roller 62. That is, as the web feed motor 210 rotates in a winding direction, the winding end portion 61*b* is wound by the driving shaft 65 serving as a winding roller, the web 61 is pulled from the feed end portion 61*a* via the web roller 63 and the support shaft 64 is driven and is rotated. Thereby, the web 61 is gradually wound up in a direction of an arrow B in FIG. 2. Then, the intermediate cleaning roller 62 is rubbed by the web 61 by this winding operation of the web 61.

The web roller 63 presses the web 61 against the intermediate cleaning roller 62. That is, the web roller 63 presses the web 61 against the intermediate cleaning roller 62 to rub the intermediate cleaning roller 62 with the web 61. It is preferable to widen a circumferential nip width between the web roller 63 and the intermediate cleaning roller 62 in order to improve cleaning ability of the web 61. To that end, the web roller 63 is configured to be an elastic roller of a heat resistant silicon sponge of 30 mm in diameter wrapped around a shaft 63*a* (see FIG. 3). The silicon sponge is then coated with a PFA tube composed of fluorocarbon resin of around 100 μm thick to prevent adhesion of toner. As illustrated in FIG. 3, the shaft 63*a* of the web roller 63 is supported movably in a direction of the intermediate cleaning roller 62, through a bearing 71, to a long hole 70*b* formed through the web frame 70 serving as a first support member of the cleaning unit 60. The shaft 63*a* of the web roller 63 is urged by a web roller pressing spring 72 serving as a pressure spring having an end portion fixed to the web frame 70 through the bearing 71.

The intermediate cleaning roller 62 serving as an intermediate cleaning member has an outer diameter of 20 mm for example and is a metallic roller such as stainless steel (e.g., SUS 303) having higher affinity with melted toner than the fixing roller 40 having the release layer. Due to that, the toner and the foreign substances adhered from the recording material S to the fixing roller 40 are collected from the fixing roller 40 to the intermediate cleaning roller 62. As illustrated in FIG. 3, the intermediate cleaning roller 62 is rotatably supported by a rotation shaft 62*a* having both ends supported by an intermediate support arm 67 serving as a second support member. The intermediate cleaning roller 62 is also enabled to move between a state in which the intermediate cleaning roller 62 comes into contact with the fixing roller 40 and a state in which the intermediate cleaning roller 62 is separated from the fixing roller 40 as the intermediate support arm 67 is operated by the contacting/separating mechanism 32 as described later. The intermediate support arm 67 is urged in a direction of the fixing roller 40 by an intermediate cleaning roller pressing spring 69.

Contacting/Separating Mechanism

Next, the contacting/separating mechanism 32 serving as a moving unit will be described with reference to FIG. 3 and FIGS. 4A through 4C. The contacting/separating mechanism 32 is configured to be able to move the intermediate cleaning roller 62 and the web 61 and to shift the intermediate cleaning roller 62, the web 61 and the fixing roller 40 in the three states of the "total contact state", "intermediate contact state" and "total separation state" as illustrated in FIGS. 4A through 4C described above.

The contacting/separating mechanism 32 includes the intermediate support arm 67 serving as the second support member supporting the intermediate cleaning roller 62, the web frame 70 serving as the first support member supporting the web 61 and a contacting/separating cam 74 serving as a separating mechanism. The intermediate support arm 67 and the web frame 70 are supported swingably centering on a common swing shaft 70*a*. The web frame 70 is formed integrally with a web arm 73, and the web roller 63 is urged in the direction of the fixing roller 40 by a spring 75 bridged between the web arm 73 and a frame not illustrated.

The contacting/separating cam 74 is provided abuttably with a contact portion 73*a* of the web arm 73 and is driven by a web contacting/separating motor 209. A spring 75 urges the web arm 73 in a direction in which the contact portion 73*a* abuts with the contacting/separating cam 74. The contacting/separating cam 74 is formed eccentrically and moves the contact portion 73*a* in a direction inverse to the urging direction of the spring 75 as the contacting/separating cam 74 is rotated clockwise in FIG. 3 centering on a rotation shaft 74*a* by the web contacting/separating motor 209. Thereby, the web frame 70 integrated with the web arm 73 swings counterclockwise in FIG. 3 centering on the swing shaft 70*a* and separates the web roller 63 and the web 61 supported by the web frame 70 from the intermediate cleaning roller 62.

Meanwhile, the contacting/separating cam 74 moves the contact portion 73*a* in the same direction with the urging direction of the spring 75 as the contacting/separating cam 74 is rotated counterclockwise in FIG. 3 centering on the rotation shaft 74*a* by the web contacting/separating motor 209. Thereby, the web frame 70 integrated with the web arm 73 swings clockwise in FIG. 3 centering on the swing shaft 70*a* and brings the web roller 63 and the web 61 supported by the web frame 70 come into contact with the intermediate cleaning roller 62.

The pressing spring 69 is bridged between the intermediate support arm 67 and a frame not illustrated, and the intermediate cleaning roller 62 is urged in the direction of the fixing roller 40 by the pressing spring 69. The intermediate support arm 67 also includes an abutment portion 67*c* butting against a restrict portion 73*b* provided on the web arm 73 integrated with the web frame 70. The restrict portion 73*b* restricts the rotational move of the intermediate cleaning roller 62 in the direction of the fixing roller 40 caused by the intermediate support arm 67 by coming into contact with the abutment portion 67*c* of the intermediate support arm 67.

The abutment portion 67*c* is disposed so as to butt against the restrict portion 73*b* after when the web 61 is separated from the intermediate cleaning roller 62 as the web frame 70 is moved by the contacting/separating cam 74 from the total contact state.

In the state in which the restrict portion 73*b* butts against the abutment portion 67*c*, the intermediate support arm 67 swings centering on the swing shaft 70*a* together with the web frame 70 as the restrict portion 73*b* abuts with the abutment portion 67*c* because the contacting/separating cam 74 is driven in the same direction further, i.e., clockwise in FIG. 3. Then, the intermediate support arm 67 is moved in a direction in which the intermediate cleaning roller 62 is separated from the fixing roller 40. That is, when the web roller 63 is separated from the intermediate cleaning roller 62, the web frame 70 comes into contact with the intermediate support arm 67 and moves the intermediate support arm 67 such that the intermediate cleaning roller 62 is separated from the fixing roller 40 along with the move of the web roller 63 of the web frame 70 in a direction of separating from the intermediate cleaning roller 62. Meanwhile, when the contacting/separating cam 74 is rotationally driven in a direction inverse to that, the intermediate support arm 67 is moved in a direction in which the intermediate cleaning roller 62 comes into contact with the fixing roller 40 by an urging force of the pressing spring 69.

The cleaning unit 60 is put into the three states as described above by the contacting/separating mechanism 32 constructed as described above. That is, the fixing roller 40 is in contact with the intermediate cleaning roller 62 and the intermediate cleaning roller 62 is also in contact with the web 61 in the total contact state as illustrated in FIG. 4A. In this state, the restrict portion 73*b* of the web arm 73 is separated from the abutment portion 67*c* of the intermediate support arm 67, and the intermediate cleaning roller 62 is pressed against the fixing roller 40. At this time, the web roller 63 presses the intermediate cleaning roller 62 with 40 N through the web 61. Still further, the pressing spring 69 urges both ends of the intermediate cleaning roller 62 toward the fixing roller 40 and presses the intermediate cleaning roller 62 against the fixing roller 40 with a force of 60 N.

By adopting the abovementioned contact relationship, the residual toner and the foreign substances adhering on the fixing roller 40 are collected first by the intermediate cleaning roller 62 that is rotationally driven by the fixing roller 40. After that, because the web 61 is pressed by the web roller 63 and is rubbed against the intermediate cleaning roller 62, the residual toner and the foreign substances collected by the intermediate cleaning roller 62 are cleaned and are removed by the web 61.

That is, as the fixing roller 40 is rotated in the state in which the web roller 63 is in contact with the intermediate cleaning roller 62 through the web 61, the residual toner and others are collected onto the intermediate cleaning roller 62 from the fixing roller 40 as the intermediate cleaning roller 62 is rotationally driven by the fixing roller 40. Then, the collected residual toner and the foreign substances are cleaned by the web 61. In this case, the web 61 in contact with the intermediate cleaning roller 62 is gradually wound up in the direction of the arrow B in FIG. 2, and a new part of the web 61 comes into contact with the intermediate cleaning roller 62 before the web 61 is saturated by toner.

During such cleaning operation, the web 61 is gradually wound up in the direction of the arrow B with a rate of 0.5 mm per recording material of A4 size along with the rotation of the web feed motor 210. According to the present exemplary embodiment, the web 61 is moved intermittently per recording material of A4 size. A speed for winding up the web 61 is set such that a new part thereof comes into contact with the intermediate cleaning roller 62 before a preceding part being in contact with the intermediate cleaning roller 62 saturates with toner. The feed end portion 61*a* of the web 61 is rotationally driven as the web 61 is wound up to the winding end portion 61*b* and supplies a non-used part of the web 61 gradually to the contact portion with the intermediate cleaning roller 62.

The intermediate contact state illustrated in FIG. 4B is a state in which the fixing roller 40 is in contact with the intermediate cleaning roller 62 and the web 61 is separated from the intermediate cleaning roller 62. That is, the cleaning unit 60 is configured to be able to switch to a state in which the intermediate cleaning roller 62 is in contact with the fixing roller 40 and is rotated together with the fixing roller 40 in a state in which the web 61 is separated from the intermediate cleaning roller 62. As the web contacting/separating motor 209 rotates the contacting/separating cam 74, the web arm 73 pivots centering on the swing shaft 70*a* as described above and moves the web 61 and the web roller 63 integrally from the total contact state or the separation state to the intermediate contact state. In the intermediate contact state, the restrict portion 73*b* of the web arm 73 is kept being separated from the abutment portion 67*c* of the intermediate support arm 67, and the intermediate cleaning roller 62 is pressed against the fixing roller 40 with the force of 60 N.

Here, in a state in which the intermediate cleaning roller 62 is not fully warmed up, the residual toner collected from the fixing roller 40 coagulates on the intermediate cleaning roller 62 or viscosity of the residual toner increases. There is a case where such residual toner cannot be fully cleaned by rubbing the web 61. In such a case, there is a possibility that the residual toner is transferred again to the fixing roller 40. Or, there is a possibility that the web 61 adheres with the intermediate cleaning roller 62 by the viscosity of the residual toner and the web 61 is drawn out and is sagged in driving the web 61.

According to the present exemplary embodiment, temperature of the intermediate cleaning roller 62 can be readily controlled because it is possible to bring only the intermediate cleaning roller 62 into contact with the fixing roller 40 including the fixing roller heater 40*a* in the intermediate contact state. Therefore, it is possible to warm up the intermediate cleaning roller 62 before bringing the web 61 into contact with the intermediate cleaning roller 62 and to suppress the problem caused by the collected residual toner described above.

In the total separation state illustrated in FIG. 4C, the fixing roller 40, the intermediate cleaning roller 62 and the web 61 are separated from each other. When the web contacting/separating motor 209 rotates the contacting/separating cam 74, the web arm 73 pivots centering on the swing shaft 70*a* as described above and moves the web 61 integrally with the web roller 63 from the total contact state to the intermediate contact state and further to the total separation state. That is, the contacting/separating cam 74 can separate the web 61 from the intermediate cleaning roller 62 when the intermediate cleaning roller 62 is separated from the fixing roller 40.

In the total separation state, the restrict portion 73*b* of the web arm 73 is in contact with the abutment portion 67*c* of the intermediate support arm 67, so that the rotational move of the intermediate cleaning roller 62 in the direction of the fixing roller 40 caused by the intermediate support arm 67 is restricted. Still further, the intermediate support arm 67 restricted by the abutment portion 67*c* rotationally moves in a direction of separating the intermediate cleaning roller 62 from the fixing roller 40 along with the rotation of the web arm 73.

At this time, the fixing roller 40 takes a clearance of around 2 mm from the intermediate cleaning roller 62. In a case of heating the fixing roller 40 from a normal temperature, e.g., 20° C., when a surface temperature of the fixing roller 40 is 100° C., temperature of the intermediate cleaning roller 62 is around 40° C. due to an influence of heat radiation from the fixing roller 40. Still further, when the fixing roller 40 is left by around 5 minutes in a state in which the surface temperature of the fixing roller 40 is 140° C. which is a lowest temperature in a case of passing the recording material through the fixing unit 9 of the present exemplary embodiment, temperature of the intermediate cleaning roller 62 rises up to about 90° C.

Because the fixing roller 40 is completely separated from the intermediate cleaning roller 62 in the total separation state, none of the residual toner and the foreign substances which have adhered on the surface of the fixing roller 40 deposit on the intermediate cleaning roller 62. Therefore, it is not necessary to execute the winding operation for rubbing the intermediate cleaning roller 62 with the web 61, and no unused portion of the web 61 is consumed. Still further, because the intermediate cleaning roller 62 is completely separated from the web 61, it is possible to suppress the toner and the foreign substances collected by the web 61 from adhering again to the intermediate cleaning roller 62 in a case where no winding operation of the web 61 is executed. It is also possible to suppress the web 61 from sticking with the intermediate cleaning roller 62 by the melted toner or the like.

Still further, as described in detail later, there are cases where the cleaning operation by the cleaning unit 60 is executed and not executed during a fixing operation of fixing a toner image on a recording material in the present exemplary embodiment. That is, the fixing unit control portion 202 can execute a first mode of putting the intermediate cleaning roller 62 and the web 61 into the total separation state during the fixing operation and a second mode of putting the intermediate cleaning roller 62 and the web 61 into the total contact state during the fixing operation.

Still further, the states are shifted from the total separation state to the total contact state via the intermediate contact state in shifting to a standby state by which an image can be formed in the present exemplary embodiment. That is, in starting the image forming apparatus by turning power on or in returning from a sleep mode, the image forming apparatus shifts to the standby state by which an image can be formed from a stop mode or the sleep mode of the image forming apparatus. The sleep mode is a mode in which power consumption is lowered than that in the standby state. Normally, the fixing unit 9 is kept in the total separation state before shifting to the standby state. Therefore, in a case where the image forming apparatus shifts to the standby state and the cleaning operation is to be performed during the fixing operation, while the fixing unit 9 is put into the total contact state from the total separation state, the intermediate contact state is included in the middle thereof in the present exemplary embodiment. That is, the fixing unit control portion 202 can execute a third mode of bringing the intermediate cleaning roller 62 into contact with the fixing roller 40 while separating the web 61 from the intermediate cleaning roller 62 and of putting the intermediate cleaning roller 62 and the web 61 into the intermediate contact state from the total separation state.

Here, the toner adhering on the fixing roller 40 is solidified in low temperature. If the intermediate cleaning roller 62 comes into contact with the fixing roller 40 in a state in which the toner is solidified, there is a case where a lump of the solidified toner scratches the surface of the fixing roller 40 at the contact portion where the intermediate cleaning roller 62 is in contact with the fixing roller 40. Due to that, the surface temperature of the fixing roller 40 is desirable to be a temperature exceeding a glass transition temperature of a base resin in the toner in use in shifting from the total separation state to the intermediate contact state in which the intermediate cleaning roller 62 is brought into contact with the fixing roller 40. That is, it is preferable for the fixing unit control portion 202 to meet the following conditions in a case of shifting from the total separation state to the intermediate contact state. Specifically, the state is shifted to the intermediate contact state in a case where the fixing roller 40 is heated up by the fixing roller heater 40*a* in the total separation state and the surface temperature of the fixing roller 40 detected by the temperature detection sensor 42*a* exceeds the predetermined temperature.

In the same manner, it is desirable to arrange such that the temperature of the intermediate cleaning roller 62 exceeds the glass transition temperature of the base resin in the toner also in shifting to the total contact state in which the web 61 is brought into contact with the intermediate cleaning roller 62. That is, it is preferable for the fixing unit control portion 202 described later to meet the following conditions in shifting from the intermediate contact state to the total contact state. Specifically, the state is shifted to the total contact state in a case where the intermediate cleaning roller 62 is heated up by the fixing roller heater 40*a* through the fixing roller 40 in the intermediate contact state and a surface temperature of the intermediate cleaning roller 62 exceeds a predetermined temperature. The abovementioned predetermined temperature is the glass transition temperature of the toner in the present exemplary embodiment. The base resin of the toner used in the present exemplary embodiment is polyester and the glass transition temperature thereof is about 80° C.

In the present exemplary embodiment, it is possible to increase the temperature of the intermediate cleaning roller 62 around to 100° C. which exceeds the glass transition temperature of the toner by about 9 seconds by bringing the intermediate cleaning roller 62 into contact with the fixing roller 40 when the temperature of the fixing roller 40 reaches 165° C. by heating the fixing roller 40 from the normal temperature state. Still further, because the temperature of the intermediate cleaning roller 62 is around 90° C. in a state in which the fixing roller 40 is left for five minutes when the surface temperature of the fixing roller 40 is 140° C., it is possible to immediately bring the intermediate cleaning roller 62 into contact with the fixing roller 40. This arrangement makes it possible to execute the cleaning operation by the intermediate cleaning roller 62 and the web 61 instantly in a case where the cleaning operation needs to be executed in passing a recording material through the fixing unit 9 for example. Still further, in a case of heating up the fixing roller 40 from the normal temperature, the temperature of the intermediate cleaning roller 62 is around 50° C. in a state where the surface temperature of the fixing roller 40 reaches 140° C., and when the intermediate cleaning roller 62 is brought into contact with the fixing roller 40 in this state, the temperature of the intermediate cleaning roller 62 reaches around 80° C. in around 6.7 seconds.

That is, the surface temperature of the intermediate cleaning roller 62 is predictable from the surface temperature of the fixing roller 40 and from a time during which the intermediate cleaning roller 62 is continuously in contact with the fixing roller 40. Note that a thermistor serving as a temperature detecting unit may be provided on the intermediate cleaning roller 62 to detect the surface temperature of the intermediate cleaning roller 62, and the shifts from the total contact state, the intermediate contact state and the total separation state may be executed based on a temperature detected by the thermistor.

Control Portion

Figure 5:
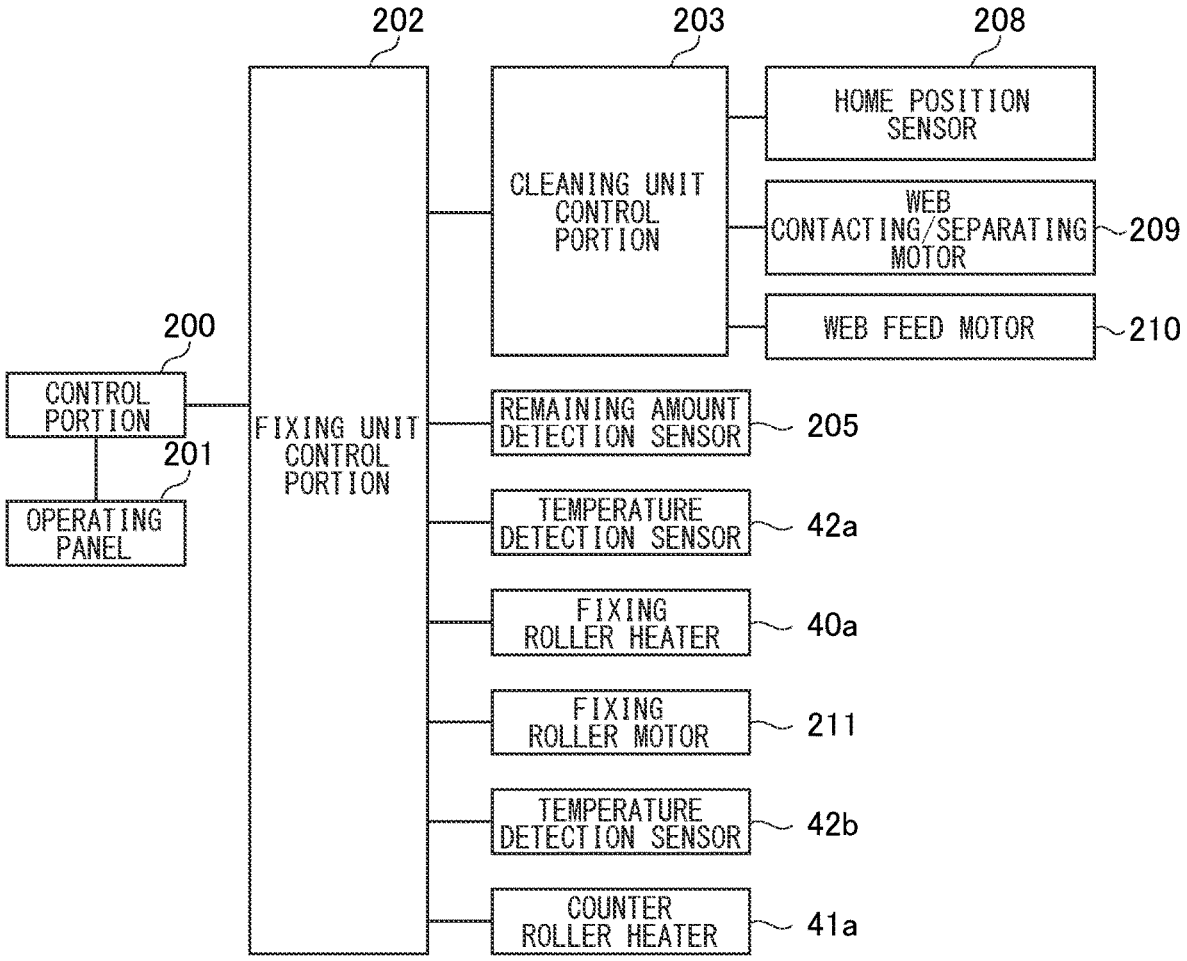
FIG. 5 is a control block diagram of the fixing unit of the present exemplary embodiment.

Next, a control system related to the fixing unit 9 of the present exemplary embodiment will be described with reference to FIG. 5. FIG. 5 is a block diagram illustrating a control system of controlling the contacting/separating operations of the cleaning unit 60 in the present exemplary embodiment. That is, the image forming apparatus 100 (see FIG. 1) is provided with the control portion 200 of a whole system integrally controlling the respective units. The control portion 200 of the whole system is connected with an operating panel 201 serving as an operating portion and the fixing unit control portion 202. The user can make various settings, e.g., setting of a type of a recording material or the like, to the image forming apparatus 100 through the operating panel 201.

Each of the control portion 200 and the fixing unit control portion 202 includes a CPU (Central Processing Unit), a ROM (Read Only Memory) and a RAM (Random Access Memory). The CPU controls the respective units while reading out a program corresponding to a control procedure stored in the ROM. The RAM stores operational data and input data, and the CPU controls while making reference to the data stored in the RAM based on the program or the like described above.

The fixing unit control portion 202 is connected with a cleaning unit control portion 203, a remaining amount detection sensor 205, the temperature detection sensor 42*a*, the fixing roller heater 40*a*, the fixing roller motor 211 and others. The fixing unit control portion 202 is also connected with the temperature detection sensor 42*b* and the counter roller heater 41*a*. The cleaning unit control portion 203 controls the cleaning unit 60.

The remaining amount detection sensor 205 is a sensor for detecting a remaining amount of the web 61. For instance, the remaining amount detection sensor 205 detects a radius of the roll of the web 61 on a feed side. Specifically, the remaining amount detection sensor 205 includes a flag being in contact with an outer circumference of the roll and detects the remaining amount of the web 61 by detecting a moving amount of the flag. It is possible to detect the remaining amount of the web 61 by detecting the moving amount of the flag in the radius direction while bringing the flag into contact with the outer circumferential face of the roll because the radius of the roll of the web 61 decreases as the web 61 is used.

The fixing unit control portion 202 controls the following controls in accordance to an instruction of the control portion 200 of the whole system based on detection signals from the temperature detection sensors 42*a* and 42*b*. That is, the fixing unit control portion 202 controls the cleaning unit 60 through the cleaning unit control portion 203 and controls the fixing roller heater 40*a*, the fixing roller motor 211 and the counter roller heater 41*a*, respectively.

The cleaning unit control portion 203 is connected with a home position sensor 208, the web contacting/separating motor 209 and a web feed motor 210. The home position sensor 208 detects a home position of the web roller 63. The web contacting/separating motor 209 is a motor for rotating the contacting/separating cam 74 as described above to bring/separate the web 61 into contact with/from the intermediate cleaning roller 62 and to bring/separate the intermediate cleaning roller 62 into contact with/from the fixing roller 40. The web feed motor 210 is a motor for rotating the driving shaft 65 serving as a winding roller for winding the web 61.

The cleaning unit control portion 203 rotates the contacting/separating cam 74 by driving the web contacting/separating motor 209 while determining a position of the web roller 63 to the intermediate cleaning roller 62 by the home position sensor 208. In conjunction with that operation, the cleaning unit control portion 203 brings/separates the web 61 into contact with/from the intermediate cleaning roller 62 while winding the web 61 by driving the web feed motor 210. According to the present exemplary embodiment, the home position sensor 208 is attached on the shaft of the contacting/separating cam 74, and a photo-interrupter that reacts, i.e., turns ON, in the total separation state described above is used.

Cleaning Operation Mode

Next, a cleaning operation mode for executing the cleaning operation in the present exemplary embodiment will be described with reference to FIG. 6. FIG. 6 is a table illustrating various operating conditions in the image forming apparatus and responses whether or not the cleaning operation is to be executed. That is, according to the present exemplary embodiment, there are cases where the cleaning operation by the cleaning unit 60 is executed and not executed depending on sheet passing conditions during a fixing operation in fixing a toner image on a recording material.

In the table, the conditions marked with round black marks indicate whether or not the cleaning operation is executed as indicated in a rightmost "determination" column. That is, the table indicates that the cleaning operation is executed under such condition if a row is marked with "execute" and that no cleaning operation is executed under such condition if a row is marked with "not execute".

Such condition includes a "use condition" and a "sheet passing condition". The "sheet passing condition" includes a "normal sheet passing condition", a "high production mode" and a "high gross mode". The high production mode" includes a "first grammage condition" and a "second grammage condition" and the "high gloss mode" includes a "first temperature condition" and a "second temperature condition".

Firstly, as the "use condition", the table describes various types of recording materials that are to be passed through the fixing unit and a case in returning from an abnormal stop such as jamming. Note that passing the recording material, i.e., the various sheets in the table, through the fixing unit will be referred to "sheet passing" hereinafter. Then, as the "sheet passing condition", the table describes the "normal sheet passing condition" in which temperature of the fixing roller 40 is selected by adjusting to a sheet type to be used and grammage and combinations of grammages and temperatures in the "high production mode" and the "high gross mode" described later.

Receiving an instruction to execute the cleaning operation from the control portion 200, the fixing unit control portion 202 drives the web contacting/separating motor 209 through the cleaning unit control portion 203. Then, the fixing unit control portion 202 operates the cleaning unit 60 so as to shift from the total separation state to the total contact state via the intermediate contact state. The "use condition" is a condition determined by sheet setting selected by the user or whether returning from an abnormality is present. A method for setting information such as the sheet type and the grammage through the operating panel 201 is well known in setting the sheet in particular.

Due to a late improvement of toner, it is a general practice to determine temperature of the fixing roller 40 corresponding to grammage of a recording material to be passed like the "normal sheet passing condition" described above. In such a "sheet passing condition", an amount of residual toner adhering on the fixing roller 40 is reduced. Therefore, the cleaning operation is not selected and the cleaning unit 60 takes the total separation state in a case where the "normal sheet passing condition" is selected except of a "recycled sheet" and an "embossed sheet".

However, due to a late demand of increasing a speed of an image forming operation, some image forming apparatus has a mode of passing a sheet in the high production mode even in a case where the image forming apparatus is loaded mixedly with thin and thick sheets. In such "high production mode", there is a case where the fixing operation is executed consecutively with the same surface temperature of the fixing roller 40 for recording materials largely different in terms of heat capacities due to different grammages. In such a case, a heat quantity becomes excessive for toner on a thin sheet having a low grammage in particular, and there is a case where excessively melted toner is separated from a lump of toner fused on the recording material side and adheres on the surface of the fixing roller 40 (called as "hot offset" hereinafter). Therefore, it is desirable to execute the cleaning operation in a case where sheets of paper containing a sheet type with grammage that is passed at a higher temperature than that of the "normal sheet passing condition" and is desirable to apply the cleaning operation preferentially to a sheet with low grammage in particular.

The fixing unit control portion 202 executes the second mode described above in a case where a plurality of sheets having different grammages is consecutively passed through the heating nip portion n3 and in a case where the plurality of recording materials includes a recording material having a grammage less than a first grammage and a recording material having a grammage more than a second grammage greater than the first grammage. That is, the fixing unit control portion 202 puts the fixing unit 9 into the total contact state to execute the cleaning operation of the fixing roller 40.

A fixing arrangement applied in the present exemplary embodiment instructs the fixing unit control portion 202 to execute the cleaning operation from the control portion 200 by setting the "first grammage condition" in a case of including recording materials having grammages of less than 91 g/m$^2$ (gsm) and of 256 g/m$^2$ (gsm) or more. This arrangement has been determined from results of an experiment in which the hot offset has occurred in a recording material of grammage of less than 91 g/m$^2$ (gsm) with a surface temperature of the fixing roller 40 by which toner can be melted and fixed to a sheet having grammage of 256 g/m$^2$ or more. Meanwhile, no cleaning operation is required for recording materials of the "second grammage condition" of 91 g/m$^2$ or more and less than 256 g/m$^2$ (gsm), except of a recycled sheet and an embossed sheet. Note that 91 g/m$^2$ corresponds to the first grammage and 256 g/m$^2$ corresponds to the second grammage, respectively.

In the same manner, there is a case of including the "high gross mode" for acquiring further glossiness. In the "high gross mode", a temperature of the fixing roller 40 is increased more than a normal fixing temperature to melt toner on a recording material more than a normal fixing state to smooth a surface of the toner. In such a case, the cleaning operation may be required because a heat quantity becomes excessive in the same manner as described above and hot offset toner may adhere on the surface of the fixing roller 40.

The fixing unit control portion 202 can execute the fixing operation in a normal temperature condition, a first high temperature condition and a second high temperature condition, respectively. The normal temperature condition is the "normal sheet passing condition" in the table in FIG. 6 in which the surface temperature of the fixing roller 40 is set at a first temperature. The first and second high temperature conditions are the "high gross mode" in the table in FIG. 6. The first high temperature condition is the "first temperature condition" in the table in FIG. 6 in which the surface temperature of the fixing roller 40 is set at a second temperature higher than the first temperature. The second high temperature condition is the "second temperature condition" in the table in FIG. 6 in which the surface temperature of the fixing roller 40 is set at a third temperature higher than the second temperature.

Then, in a case where the recording material is a plain sheet of paper, the first mode is executed in a case of executing the fixing operation in the "normal sheet passing condition", and the second mode is executed in a case of executing the fixing operation in the "first temperature condition". Still further, in a case where the recording material is a plain sheet of paper, the second mode is executed also in a case of executing the fixing operation in the "second temperature condition". That is, in the case of the plain sheet of paper, no cleaning operation is executed in the "normal sheet passing condition" and the cleaning operation is executed in the high gloss mode.

Still further, in a case where surface irregularity of a recording material is smaller than that of a plain sheet of paper, i.e., in a case of a gloss sheet, a film and a resin sheet, and in a case of executing the fixing operation in the "normal sheet passing condition" and the "first temperature condition", the first mode is executed. Meanwhile, in a case of executing the fixing operation in the "second temperature condition" in this case, the second mode is executed. That is, in a case where the recording material is a gloss sheet, a film or a resin sheet, no cleaning operation is executed in the "normal sheet passing condition" and the "first temperature condition", and the cleaning operation is executed in the "second temperature condition".

The fixing arrangement applied in the present exemplary embodiment determines whether or not the cleaning operation is to be executed by setting a sheet passing condition higher than the surface temperature of the fixing roller 40 in the "normal sheet passing condition" by 10° C. or more as the "first temperature condition" and a sheet passing condition higher than the surface temperature of the fixing roller 40 by 15° C. or more as the "second temperature condition". In a case of a plain sheet of paper such as a fine paper which is a normal sheet, the cleaning operation is instructed to be executed in the "first temperature condition" and the "second temperature condition". Meanwhile, in a case of a gloss sheet such as a coated sheet having better surface nature, i.e., surface smoothness is higher, than the plain sheet of paper, a film and a resin sheet including an OHT sheet, the cleaning operation is instructed to be executed in the "second temperature condition". It is because excessively melted toner is liable to remain on the surface of the fixing roller 40 because adhesiveness between the surface layer of the fixing roller 40 and the recording material drops in the sheet having the large surface irregularity.

Still further, in a case of a sheet having large surface irregularity such as an embossed sheet and a recycled sheet, the adhesiveness between the surface layer of the fixing roller 40 and the recording material is low even in temperature setting of the "normal sheet passing condition", so that enough heat may not be conducted to the toner. In such a case, the toner may adhere on the surface of the fixing roller 40 as the toner may not be fully melted on the recording material. Still further, if the surface temperature of the fixing roller 40 is set higher than the "normal sheet passing condition", excessively melted toner remains as described above. Due to that, the control portion 200 instructs to execute the cleaning operation regardless of the "sheet passing condition" in the condition of using the recycled sheet, the embossed sheet and the like. That is, the fixing unit control portion 202 executes the second mode in the fixing operation in a case where the recording material is the recycled sheet or the embossed sheet.

Still further, in a state in which the recording material stops within the fixing unit 9 due to abnormality such as a conveyance failure, i.e., in a jammed state, there is a case where the toner on the recording material is cooled and is solidified between the recording material and the fixing roller 40, thus remaining on the surface of the fixing roller 40. There is also a case where the toner before being melted on the fixing roller 40 adheres on the fixing roller 40 in removing the recording material, i.e., in treating a jam. Therefore, it is desirable to execute the cleaning operation even after the jammed state.

Therefore, according to the present exemplary embodiment, the control portion 200 instructs to execute the cleaning operation in the "case of returning from abnormality" after the occurrence of a process for the abnormal stop such as a jam treatment and before when no cleaning operation has been executed yet. In such a case, it is desirable to execute the cleaning operation immediately even during a starting control of shifting the fixing roller 40 to a predetermined temperature regardless of the "sheet passing condition". That is, the fixing unit control portion 202 puts the intermediate cleaning roller 62 and the web 61 into the total contact state to execute the cleaning operation to clean the fixing roller 40 when the image forming apparatus 100 executes a return operation to resume the fixing operation after being stopped due to the abnormality.

While a method for selecting the "use condition" and the "sheet passing condition" has been described by exemplifying the case where the user inputs them through the operating panel 201 or the like, any method may be adopted as long as the method enables to set the similar conditions such as printing setting from a personal computer, automatic setting in the image forming apparatus or the like.

One Example of Cleaning Operation

Figure 7:
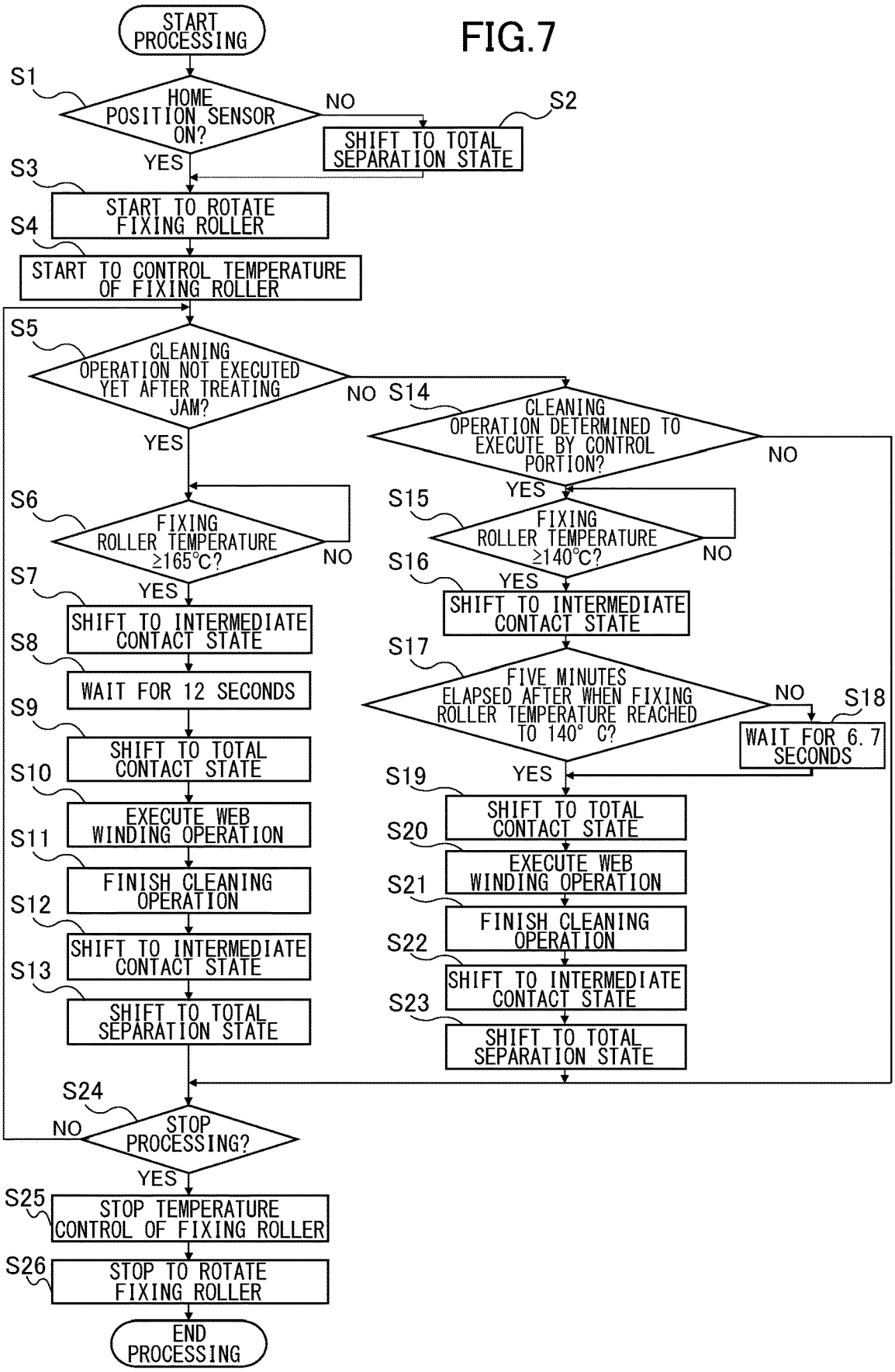
FIG. 7 is a flowchart indicating one example of a cleaning operation of the present exemplary embodiment.

Next, one example of the cleaning operation of the present exemplary embodiment will be described by using FIG. 7 and with reference to FIG. 5. When the image forming apparatus 100 or the fixing unit 9 is started at first, the fixing unit control portion 202 confirms whether the home position sensor 208 is turned ON in Step S1. In a case where the home position sensor 208 is OFF, i.e., No in Step S1, the fixing unit control portion 202 operates the web contacting/separating motor 209 such that the intermediate cleaning roller 62 and the web 61 are put into the total separation state in Step S2. In the total separation state, the home position sensor 208 is turned ON.

Next, the fixing unit control portion 202 operates the fixing roller motor 211 to start to rotate the fixing roller 40 in Step S3. When the fixing roller 40 starts to rotate, the fixing unit control portion 202 starts temperature control of the fixing roller 40 based on detection results of the fixing roller heater 40*a* and the temperature detection sensor 42*a* based on an instruction from the control portion 200 in Step S4.

The fixing unit control portion 202 determines whether no cleaning operation has been executed right after the above-mentioned jammed state, i.e., after treating a jam, in Step S5. If no cleaning operation has been executed yet, i.e., Yes in Step S5, the fixing unit control portion 202 shifts to the cleaning operation automatically.

In the cleaning operation, the fixing unit control portion 202 waits until when a surface temperature of the fixing roller 40 increases to 165° C. or more which is higher than a glass transition temperature of a base resin of toner to be used in Step S6. Then, when the surface temperature of the fixing roller 40 increases to 165° C. or more, i.e., Yes in Step S6, the fixing unit control portion 202 shifts the state to the intermediate contact state in which the intermediate cleaning roller 62 is brought into contact with the fixing roller 40 by operating the web contacting/separating motor 209 in Step S7. That is, the fixing unit control portion 202 brings the intermediate cleaning roller 62 into contact with the fixing roller 40 in a case where a temperature detected by the temperature detection sensor 42*a* is higher than a predetermined temperature in cleaning the fixing roller 40. The fixing unit control portion 202 waits for 12 seconds for example as a standby time in the state in which the intermediate cleaning roller 62 is in contact with the fixing roller 40 in Step S8. This standby time, i.e., a predetermined time, is a time for increasing the surface temperature of the intermediate cleaning roller 62 to 100° C. or more which is higher than the glass transition temperature of the base resin. After waiting for 12 seconds, the fixing unit control portion 202 operates the web contacting/separating motor 209 to shift to the total contact state in which the fixing roller 40 comes into contact with the intermediate cleaning roller 62 and the intermediate cleaning roller 62 comes into contact with the web 61, respectively in Step S9. That is, the cleaning unit 60 brings the web 61 into contact with the intermediate cleaning roller 62 after bringing the intermediate cleaning roller 62 into contact with the fixing roller 40 in cleaning the fixing roller 40. The fixing unit control portion 202 brings the web 61 into contact with the intermediate cleaning roller 62 after an elapse of a predetermined period after bringing the intermediate cleaning roller 62 into contact with the fixing roller 40.

The total contact state enables to clean the surface of the fixing roller 40 as the web 61 sweeps the residual toner and the foreign substances collected by the intermediate cleaning roller 62 from the fixing roller 40. The fixing unit control portion 202 operates the web feed motor 210 to execute an operation of winding the web 61 such that a new part of the web 61 comes into contact with the intermediate cleaning roller 62 before a part of the web 61 being in contact with the intermediate cleaning roller 62 is saturated by the foreign substances such as the toner in Step S10. Then, after finishing the cleaning operation in Step S11, the fixing unit control portion 202 operates the web contacting/separating motor 209 to shift the state to the total separation state in Step S13 via the intermediate contact state in Step S12.

Meanwhile, even if the cleaning operation has been executed after treating the jam, i.e., No in Step S5, the control portion 200 determines whether the cleaning operation is necessary in Step S14. In a case where the cleaning operation is necessary, i.e., Yes in Step S14, the fixing unit control portion 202 shifts to the cleaning operation. A criterion of the determination whether the cleaning operation is necessary is made based on the conditions in the table illustrated in FIG. 6 for example.

In the cleaning operation, in a case where the surface temperature of the fixing roller 40 is 140° C. or more, i.e., Yes in Step S15, the fixing unit control portion 202 shifts to the intermediate contact state in Step S16. Then, in a case where a time during which the temperature of the fixing roller 40 is kept at 140° C. or more is less than 5 minutes, i.e., No in Step S17, the fixing unit control portion 202 waits for 6.7 seconds for example in Step S18 and shifts to the total contact state in Step S19. In a case where the time during which the temperature of the fixing roller 40 is kept at 140° C. or more is more than 5 minutes, i.e., Yes in Step S17, the fixing unit control portion 202 shifts immediately to the total contact state in Step S19.

This arrangement makes it possible to bring the intermediate cleaning roller 62, the fixing roller 40 and the web 61 into contact in a state in which the surface temperature of the intermediate cleaning roller 62 is higher than the glass transition temperature of the base resin of the toner to be adopted. During the cleaning operation, the web 61 is gradually wound up in the direction of the arrow B (see FIG. 2) along with the rotation of the web feed motor 210 at a rate of 0.5 mm per A4 paper in Step S20.

After finishing the cleaning operation in Step S21, the fixing unit control portion 202 operates the web contacting/separating motor 209 to shift the state via the intermediate contact state in Step S22 to the total separation state in Step S23.

The fixing unit control portion 202 determines whether the process is to be stopped or not in Step S24 in the case where the state has been put into the total separation state in Steps S13 and S23 and in the case where the cleaning operation is determined to be unnecessary, i.e., No in Step S14, after the cleaning operation as described above. For instance, the fixing unit control portion 202 determines whether the fixing operation has been made on a final recording material of an image forming job. In a case of stopping the process or in the case where the fixing operation has been made on the final recording material for example, i.e., Yes in Step S24, the fixing unit control portion 202 stops the temperature control of the fixing roller 40 in Step S25 and stops the rotation of the fixing roller 40 in Step S26. Thereby, the abovementioned process is stopped. Meanwhile, the process returns to Step S5 in a case where the fixing unit control portion 202 determines not to stop the process because the recording material is not the final recording material for example, i.e., No in Step S24.

As described above, the present exemplary embodiment enables to adjust the temperature of the intermediate cleaning roller 62 in the intermediate contact state and to collect the foreign substances by the web 61 in the total contact state. The present exemplary embodiment enables to prolong a life of the web 61 and to stabilize the cleaning ability because it is not always necessary to bring the web 61 into contact with the intermediate cleaning roller 62.

Specifically, the present exemplary embodiment enables to suppress the web 61 from adhering with the intermediate cleaning roller 62 in such arrangement of suppressing a consumption amount of the web 61. That is, the cleaning unit 60 can move the intermediate cleaning roller 62 and the web 61 to the total separation state and also to the total contact state. Therefore, it is possible to execute the fixing operation while being in the total separation state depending on conditions and to suppress the consumption amount of the web 61. Still further, because the intermediate cleaning roller 62 and the web 61 are thus put into the total separation state so as not execute the cleaning operation during the fixing operation, it is possible to suppress the intermediate cleaning roller 62 and the web 61 from adhering with each other by the toner during that time. Accordingly, it is possible to suppress the web 61 from being drawn out in a next operation.

The present exemplary embodiment also enables to shift the intermediate cleaning roller 62 and the web 61 to the intermediate contact state in which the intermediate cleaning roller 62 is brought into contact with the fixing roller 40 and the web 61 is separated from the intermediate cleaning roller 62. For instance, there is a case where the intermediate cleaning roller 62 is cool in shifting to a standby state in returning from a sleep state. In such a case, there is a possibility that the fixing roller 40 cannot be fully cleaned by the intermediate cleaning roller 62. Therefore, the present exemplary embodiment shifts the state into the intermediate contact state in which the intermediate cleaning roller 62 is brought into contact with the fixing roller 40 in shifting to the standby state to bring the web 61 into contact with the intermediate cleaning roller 62 after warming up the intermediate cleaning roller 62. Then, the present exemplary embodiment executes the cleaning operation.

Other Embodiments

While the fixing unit has been described to have a configuration of fixing a non-fixed toner image onto a sheet, i.e., a recording material, the fixing unit may be a heating processing unit that heats a recording material borne with a fixed image or a semi-fixed image to modify surface nature of the image. Still further, while the intermediate cleaning roller has been brought into contact with the fixing roller in the present exemplary embodiment, the intermediate cleaning roller may be brought into contact with a pressing rotary member such as a pressure roller.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-005982, filed Jan. 17, 2020 which is hereby incorporated by reference herein in its entirety.

What is claimed is:

1. An image forming apparatus comprising:

an image forming unit configured to form a toner image on a recording material;

a first rotary member configured to heat the toner image formed on the recording material;

a second rotary member cooperatively forming a nip portion with the first rotary member and configured to nip and convey the recording material while pressing the toner image at the nip portion; and a cleaning mechanism configured to clean the first rotary member, wherein the cleaning mechanism includes:

a collecting roller coming into contact with the first rotary member to collect toner on the first rotary member;

a cleaning web coming into contact with the collecting roller to clean the collecting roller;

a pressing member configured to press the cleaning web against the collecting roller;

a winding roller configured to wind the cleaning web;

a first support member configured to support the cleaning web, the winding roller and the pressing member; and a second support member configured to support the collecting roller, wherein the first support member and the second support member are supported movably respectively, wherein in a case where the first support member moves by a first predetermined amount, the cleaning web is separated from the collecting roller, and wherein in a case where the first support member moves by a second predetermined amount which is larger than the first predetermined amount, the first support member comes into contact with the second support member and moves with the second support member integrally to separate the collecting roller from the first rotary member in a state that the cleaning web is separated from the collecting roller.

2. The image forming apparatus according to claim 1, wherein the cleaning mechanism includes:

a cam configured to move the first support member; and a motor configured to drive the cam, wherein the first support member and the second support member are supported rotatably respectively, wherein in a case where the cam rotates by a first rotation amount, the first support member is rotated such that the cleaning web moves from a contact position where the cleaning web is in contact with the collecting roller to a separation position where the cleaning web separates from the collecting roller, and wherein in a case where the cam rotates by a second rotation amount which is larger than the first rotation amount, the first support member comes into contact with the second support member after the cleaning web separates from the collecting roller, and rotates with the second support member integrally to separate the collecting roller from the first rotary member in the state that the cleaning web is separated from the collecting roller.

3. The image forming apparatus according to claim 2, wherein the cleaning mechanism comprises:

a press spring configured to press the first support member to press the pressing member to the collecting roller.

4. The image forming apparatus according to claim 2, wherein the cleaning mechanism comprises:

a press spring configured to press the second support member to press the collecting roller to the first rotary member.

5. The image forming apparatus according to claim 1, wherein the collecting roller is a metallic roller.

6. The image forming apparatus according to claim 1, wherein the pressing member is an elastic roller including an elastic layer.

7. An image forming apparatus comprising:

an image forming unit configured to form a toner image on a recording material;

a first rotary member configured to heat the toner image formed on the recording material;

a second rotary member cooperatively forming a nip portion with the first rotary member and configured to nip and convey the recording material while pressing the toner image at the nip portion; and a cleaning mechanism configured to clean the first rotary member, the cleaning mechanism including a collecting roller coming into contact with the first rotary member to collect toner on the first rotary member and a cleaning web coming into contact with the collecting roller to clean the collecting roller, wherein the cleaning mechanism is capable of switching to a first state in which the cleaning web is separated from the collecting roller and the collecting roller is separated from the first rotary member, a second state in which the collecting roller is in contact with the first rotary member and the cleaning web is separated from the collecting roller, and a third state in which the cleaning web is in contact with the collecting roller and the collecting roller is in contact with the first rotary member.

* * * * *